US009824846B2

(12) United States Patent
Lee et al.

(10) Patent No.: US 9,824,846 B2
(45) Date of Patent: Nov. 21, 2017

(54) DUAL MATERIAL REPELLER

(71) Applicant: Varian Semiconductor Equipment Associates, Inc., Gloucester, MA (US)

(72) Inventors: William Davis Lee, Newburyport, MA (US); Alexander S. Perel, Danvers, MA (US); David P. Sporleder, Billerica, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 0 days.

(21) Appl. No.: 15/007,853

(22) Filed: Jan. 27, 2016

(65) Prior Publication Data

US 2017/0213684 A1 Jul. 27, 2017

(51) Int. Cl.
*H01J 27/02* (2006.01)
*H01J 27/20* (2006.01)

(52) U.S. Cl.
CPC ..... *H01J 27/022* (2013.01); *H01J 27/205* (2013.01)

(58) Field of Classification Search
USPC ..... 250/423 R, 424, 426, 427; 313/359.1, 313/363.1; 315/111.21, 111.51, 111.61
See application file for complete search history.

(56) References Cited

U.S. PATENT DOCUMENTS 5,703,372 A 12/1997 Horsky et al.
6,583,544 B1 * 6/2003 Horsky ..... H01J 27/12 250/492.2
2006/0163489 A1 7/2006 Low et al.
2008/0230713 A1 * 9/2008 Huang ..... H01J 27/08 250/426
2009/0008570 A1 1/2009 Chen
2010/0051825 A1 3/2010 Yamashita et al.
2012/0013249 A1 * 1/2012 Jerez ..... H01J 27/08 313/613
2012/0255490 A1 10/2012 Tanjo
2015/0179393 A1 * 6/2015 Colvin ..... H01J 37/08 250/427

FOREIGN PATENT DOCUMENTS

KR 2001-0108731 A 12/2001

OTHER PUBLICATIONS

International Search Report and Written Opinion dated Mar. 31, 2017 in corresponding PCT application No. PCT/US2016/067584.

* cited by examiner

*Primary Examiner* — Kiet T Nguyen
(74) *Attorney, Agent, or Firm* — Nields, Lemack & Frame, LLC

(57) ABSTRACT

The IHC ion source comprises an ion source chamber having a cathode and a repeller on opposite ends. The repeller is made of two discrete parts, each comprising a different material. The repeller includes a repeller head, which may be a disc shaped component, and a stem to support the head. The repeller head is made from a conductive material having a higher thermal conductivity than the stem. In this way, the temperature of the repeller head is maintained at a higher temperature than would otherwise be possible. The higher temperature limits the build-up of material on the repeller head, which improves the performance of the IHC ion source. In certain embodiments, the repeller head and the stem are connected using a press fit. Differences in the coefficient of thermal expansion of the repeller head and the stem may cause the press fit to become tighter at higher temperatures.

21 Claims, 3 Drawing Sheets

DUAL MATERIAL REPELLER

FIELD

Embodiments of the present disclosure relate to an indirectly heated cathode (IHC) ion source, and more particularly, an IHC ion source having a repeller made of two different materials.

BACKGROUND

Indirectly heated cathode (IHC) ion sources operate by supplying a current to a filament disposed behind a cathode. The filament emits thermionic electrons, which are accelerated toward and heat the cathode, in turn causing the cathode to emit electrons into the ion source chamber. The cathode is disposed at one end of the ion source chamber. A repeller is typically disposed on the end of the ion source chamber opposite the cathode. The repeller may be biased so as to repel the electrons, directing them back toward the center of the ion source chamber. In some embodiments, a magnetic field is used to further confine the electrons within the ion source chamber. The electrons cause a plasma to be created. Ions are then extracted from the ion source chamber through an extraction aperture.

One issue associated with IHC ion sources is that the cathode and repeller may have a limited lifetime. The cathode is subjected to bombardment from electrons on its back surface, and by positively charged ions on its front surface. This bombardment results in sputtering, which causes erosion of the cathode.

Further, in some embodiments, tungsten or carbon like material may grow on the surface of the repeller. These deposits may reduce the efficiency of the ion source, or may lead to issues with the plasma, such as, for example, non-uniformity of extracted ribbon ion beams. Further, these deposits may also introduce contaminants into the extracted ion beam and reduce the life of the ion source.

Therefore, an IHC ion source in which material did not build up on the repeller may be beneficial. This IHC ion source may have improved life, performance and beam uniformity.

SUMMARY

The IHC ion source comprises an ion source chamber having a cathode and a repeller on opposite ends. The repeller is made of two discrete parts, each comprising a different material. The repeller includes a repeller head, which may be a disc shaped component, and a stem to support the head. The repeller head is made from a conductive material having a higher thermal conductivity than the stem. In this way, the temperature of the repeller head is maintained at a higher temperature than would otherwise be possible. The higher temperature limits the build-up of material on the repeller head, which improves the performance of the IHC ion source. In certain embodiments, the repeller head and the stem are connected using a press fit or an interference fit. Differences in the coefficient of thermal expansion of the repeller head and the stem may cause the press fit to become tighter at higher temperatures.

According to one embodiment, an indirectly heated cathode ion source is disclosed. The indirectly heated cathode ion source comprises an ion source chamber into which a gas is introduced; a cathode disposed on one end of the ion source chamber; and a repeller disposed at an opposite end of the ion source chamber, the repeller comprising a repeller head disposed within the ion source chamber and a stem that supports the repeller head and exits the ion source chamber through an opening; wherein the repeller head is made of a first material and the stem is made from a second material, different than the first material. In certain embodiments, the first material has a first thermal conductivity and the second material has a second thermal conductivity and the first thermal conductivity is greater than the second thermal conductivity. In some embodiments, the second thermal conductivity is less than half of the first thermal conductivity. In some embodiments, the second thermal conductivity is less than a third of the first thermal conductivity. In certain embodiments, the repeller head and the stem are connected using a press fit. In some embodiments, the repeller head comprises a cavity disposed on a back surface, and wherein the stem is inserted into the cavity. In other embodiments, the repeller head comprises a post disposed on a back surface, and a cavity is disposed at an end of the stem, and the post is inserted into the cavity.

According to a second embodiment, a repeller for use within an ion source chamber is disclosed. The repeller comprises a repeller head disposed within the ion source chamber; and a stem that supports the repeller head and exits the ion source chamber through an opening; wherein the repeller head is made of a first material and the stem is made from a second material, different than the first material, wherein the first material has a higher thermal conductivity than the second material. In some embodiments, the repeller head comprises tungsten. In certain embodiments, the stem is in electrical communication with a repeller power supply to supply a voltage to the repeller head.

According to a third embodiment, a repeller for use within an ion source chamber is disclosed. The repeller comprises a disc-shaped repeller head disposed within the ion source chamber and biased at a voltage; and a stem attached to a back surface of the disc-shaped repeller head and exiting the ion source chamber through an opening; wherein the disc-shaped repeller head and the stem are both electrically conductive and made from materials having a melting point greater than 1000° C., and wherein a thermal conductivity of the disc-shaped repeller head is at least twice as great as a thermal conductivity of the stem. In certain embodiments, the stem is made from a material selected from the group consisting of tantalum, titanium, rhenium, hafnium, stainless steel, KOVAR® and INVAR®.

BRIEF DESCRIPTION OF THE FIGURES

For a better understanding of the present disclosure, reference is made to the accompanying drawings, which are incorporated herein by reference and in which.

DETAILED DESCRIPTION

As described above, indirectly heated cathode ion sources may be susceptible to performance issues due to material build-up on the surface of the repeller. As the material grows on the surface of the repeller, the uniformity of the extracted ribbon ion beam may be degraded.

Figure 1:
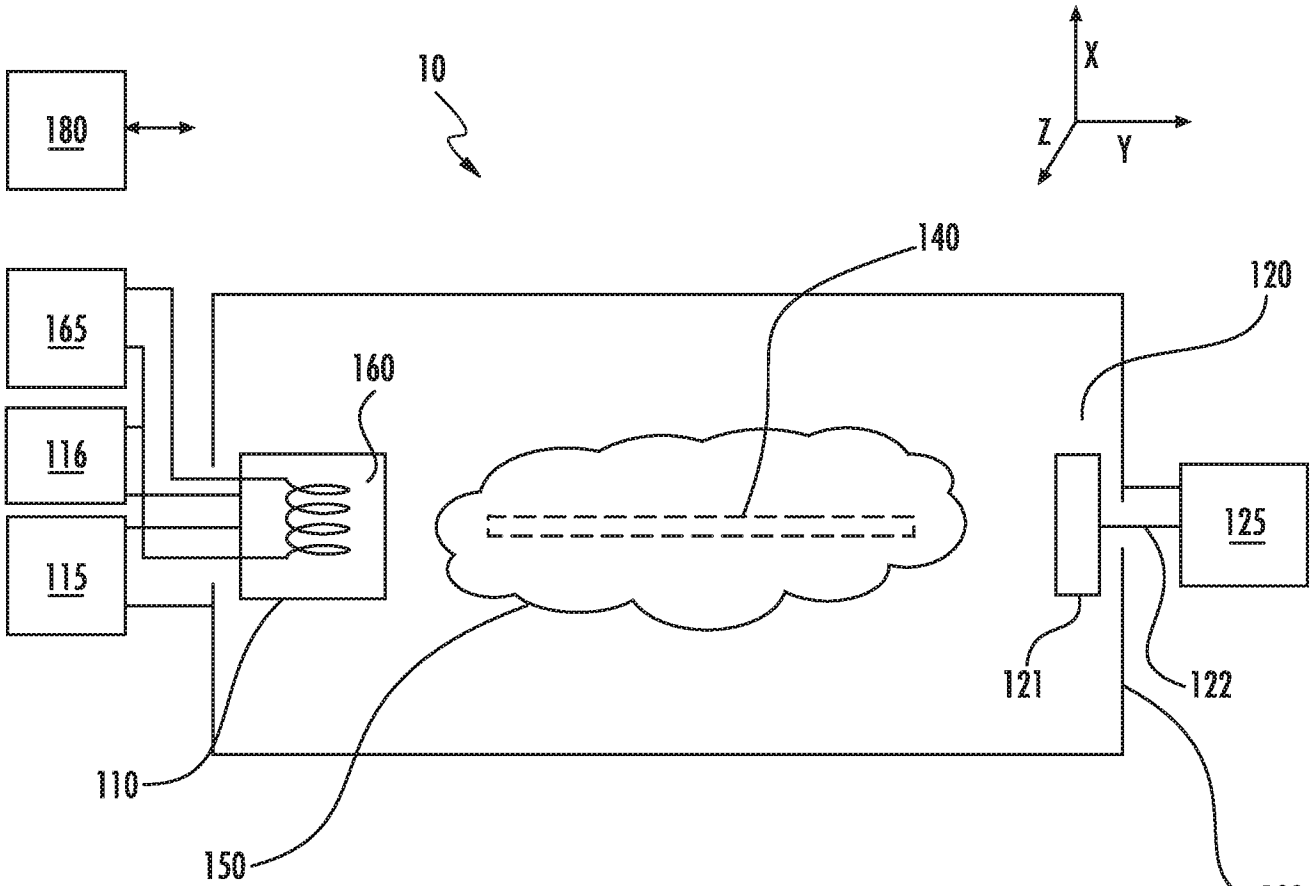
FIG. 1 is an ion source in accordance with one embodiment.

FIG. 1 shows an IHC ion source 10 that overcomes this issue. The IHC ion source 10 includes an ion source chamber 100, having two opposite ends, and sides connecting to these ends. The ion source chamber 100 may be constructed of an electrically conductive material. A cathode 110 is disposed inside the ion source chamber 100 at one of the ends of the ion source chamber 100. This cathode 110 is in communication with a cathode power supply 115, which serves to bias the cathode 110 with respect to the ion source chamber 100. In certain embodiments, the cathode power supply 115 may negatively bias the cathode 110 relative to the ion source chamber 100. For example, the cathode power supply 115 may have an output in the range of 0 to −150V, although other voltages may be used. In certain embodiments, the cathode 110 is biased at between 0 and −40V relative to the ion source chamber 100. A filament 160 is disposed behind the cathode 110. The filament 160 is in communication with a filament power supply 165. The filament power supply 165 is configured to pass a current through the filament 160, such that the filament 160 emits thermionic electrons. Cathode bias power supply 116 biases filament 160 negatively relative to the cathode 110, so these thermionic electrons are accelerated from the filament 160 toward the cathode 110 and heat the cathode 110 when they strike the back surface of cathode 110. The cathode bias power supply 116 may bias the filament 160 so that it has a voltage that is between, for example, 300V to 600V more negative than the voltage of the cathode 110. The cathode 110 then emits thermionic electrons on its front surface into ion source chamber 100.

Thus, the filament power supply 165 supplies a current to the filament 160. The cathode bias power supply 116 biases the filament 160 so that it is more negative than the cathode 110, so that electrons are attracted toward the cathode 110 from the filament 160. Finally, the cathode power supply 115 biases the cathode 110 more negatively than the ion source chamber 100.

A repeller 120 is disposed inside the ion source chamber 100 on the end of the ion source chamber 100 opposite the cathode 110. The repeller 120 may be in communication with repeller power supply 125. As the name suggests, the repeller 120 serves to repel the electrons emitted from the cathode 110 back toward the center of the ion source chamber 100. For example, the repeller 120 may be biased at a negative voltage relative to the walls of the ion source chamber 100 to repel the electrons. Like the cathode power supply 115, the repeller power supply 125 may negatively bias the repeller 120 relative to the walls of the ion source chamber 100. For example, the repeller power supply 125 may have an output in the range of 0 to −150V, although other voltages may be used. In certain embodiments, the repeller 120 is biased at between 0 and −40V relative to the walls of the ion source chamber 100.

In certain embodiments, the cathode 110 and the repeller 120 may be connected to a common power supply. Thus, in this embodiment, the cathode power supply 115 and repeller power supply 125 are the same power supply.

Although not shown, in certain embodiments, a magnetic field is generated in the ion source chamber 100. This magnetic field is intended to confine the electrons along one direction. For example, electrons may be confined in a column that is parallel to the direction from the cathode 110 to the repeller 120 (i.e. the y direction).

Disposed on another side of the ion source chamber 100 may be a faceplate including an extraction aperture 140. In FIG. 1, the extraction aperture 140 is disposed on a side that is parallel to the X-Y plane (parallel to the page). Further, while not shown, the IHC ion source 10 also comprises a gas inlet through which the gas to be ionized is introduced into the ion source chamber 100.

A controller 180 may be in communication with one or more of the power supplies such that the voltage or current supplied by these power supplies may be modified. The controller 180 may include a processing unit, such as a microcontroller, a personal computer, a special purpose controller, or another suitable processing unit. The controller 180 may also include a non-transitory storage element, such as a semiconductor memory, a magnetic memory, or another suitable memory. This non-transitory storage element may contain instructions and other data that allows the controller 180 to maintain appropriate voltages for the filament 160, the cathode 110 and the repeller 120.

During operation, the filament power supply 165 passes a current through the filament 160, which causes the filament to emit thermionic electrons. These electrons strike the back surface of the cathode 110, which may be more positive than the filament 160, causing the cathode 110 to heat, which in turn causes the cathode 110 to emit electrons into the ion source chamber 100. These electrons collide with the molecules of gas that are fed into the ion source chamber 100 through the gas inlet. These collisions create ions, which form a plasma 150. The plasma 150 may be confined and manipulated by the electrical fields created by the cathode 110, and the repeller 120. In certain embodiments, the plasma 150 is confined near the center of the ion source chamber 100, proximate the extraction aperture 140. The ions are then extracted through the extraction aperture as an ion beam.

The repeller 120 is made up of a repeller head 121 and a stem 122. The repeller head 121 may be a disc-shaped structure which is disposed within the ion source chamber 100. The stem 122 is attached to the repeller head 121 and exits through an opening in the ion source chamber 100 to allow connection of the repeller 120 to the repeller power supply 125. In certain embodiments, the stem 122 may be held in place by a clamp (not shown) on the exterior of the ion source chamber 100, which may be constructed from molybdenum or a molybdenum alloy, such as, for example, TZM, which comprises titanium, zirconium, carbon with the balance being molybdenum. The stem 122 has a much smaller cross-sectional area than the repeller head 121. The repeller head 121 is intended to provide a charged surface to repel electrons. In contrast, the stem 122 is intended to provide mechanical support and electrical conductivity between the repeller head 121 and the exterior of the ion source chamber 100. Thus, to minimize the size of the opening in the ion source chamber 100, the cross-sectional area of the stem 122 may be minimized.

The repeller head 121 may be made of a first electrically conductive material, having a first thermal conductivity. The stem 122 may be made of a second electrically conductive material, different from the first electrically conductive material, and having a second thermal conductivity less than the first thermal conductivity.

In some embodiments, the second thermal conductivity is less than half of the first thermal conductivity. In certain embodiments, the second thermal conductivity is less than a third of the first thermal conductivity.

In operation, the repeller head 121 is heated by the energy introduced into the ion source chamber 100. For example, the plasma 150 may have an elevated temperature. Further, the repeller head 121 may be struck by energetic ions or electrons disposed inside the ion source chamber 100. Radiation of the plasma 150 and the other components in the ion source chamber 100 will also transfer heat to the repeller 120. These various phenomena serve to heat the repeller head 121. Some of this heat is removed by thermal conduction through the stem 122 to the components external to the ion source chamber 100. By using a second material having a lower thermal conductivity than the repeller head 121, the amount of heat that is removed from the repeller head 121 may be reduced.

For example, traditionally, the repeller head 121 and the stem 122 are both constructed from tungsten. During operation, the repeller head may maintain a first temperature of about 600° C. during normal operation, and a second temperature of about 800° C. during high power operation. By replacing the tungsten stem, which has a thermal conductivity of around 150 W $m^{-1}$ $K^{-1}$, with a stem made of tantalum, for example, which has a thermal conductivity of around 50 W $m^{-1}$ $K^{-1}$, the temperature of the repeller head 121 increases to 720° C. during normal operation and 1100° C. during high power operation. Thus, a material having a thermal conductivity that is about a third that of tungsten causes a significant increase in the temperature of the repeller head 121.

Increased temperature of the repeller head 121 may reduce the rate and amount of material that build up on the surface of the repeller head 121. For example, it has been observed that less material builds up on the cathode 110, which is known to be at a higher temperature than the repeller 120.

Figure 2A:
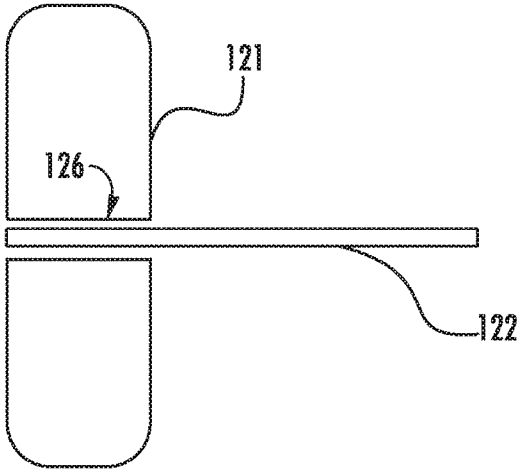
FIGS. 2A-2D show views of the connection between the repeller head and the stem according to various embodiments.

The repeller head 121 and the stem 122 may be joined using a press fit. For example, one of the repeller head 121 and the stem 122 may include a cavity, while the other comprises a post that may be inserted into the cavity. FIG. 2A shows a first embodiment where a hole 126 is drilled through the repeller head 121. The stem 122 is pressed into the hole 126.

Figure 2B:
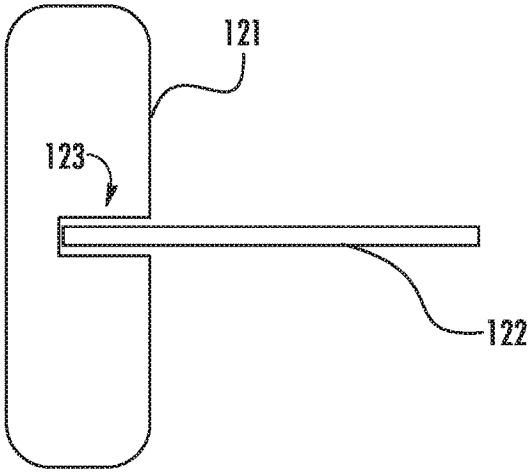

FIG. 2B shows a second embodiment illustrating the connection between the repeller head 121 and the stem 122. In this embodiment, a recessed cavity 123 is created within the back surface of the repeller head 121, such that the recessed cavity 123 does not extend to the front surface of the repeller head 121. In this disclosure, the front surface of the repeller head is that surface that faces toward the center of the ion source chamber 100. The back surface of the repeller head 121 is that surface that faces toward an end of the ion source chamber 100. The stem 122 is then inserted into the recessed cavity 123.

Figure 2C:
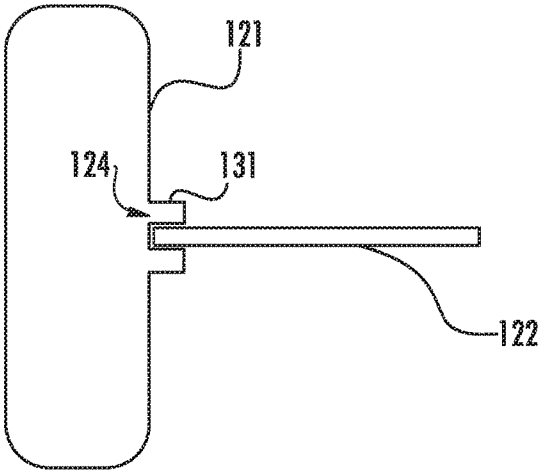

FIG. 2C shows a third embodiment illustrating the connection between the repeller head 121 and the stem 122. In this embodiment, a cavity 124 is created on the back surface of the repeller head 121 by extending the material such that it forms a raised annular ring 131. The stem 122 then is pressed into the cavity 124.

Figure 2D:
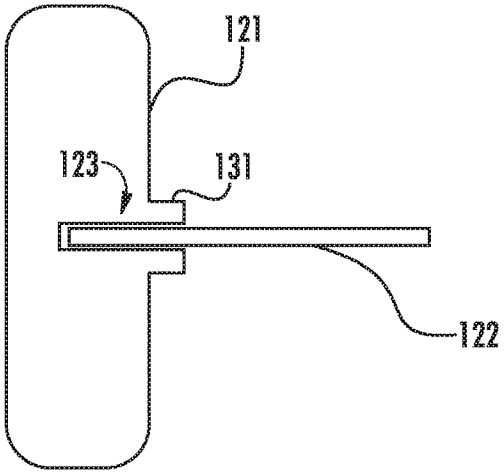

In another embodiment, the embodiments of FIGS. 2B and 2C may be combined such that there is a raised annular ring 131 and a recessed cavity 123. This embodiment is illustrated in FIG. 2D.

In each of these embodiments, it may be desirable that the coefficient of thermal expansion of the stem 122 is greater than that of the repeller head 121. In this way, as the repeller 120 heats, the stem 122 expands more than the cavity, which tightens the fit.

Further, in certain embodiments, the repeller head 121 may be made of tungsten. Thus, for the embodiments of the FIGS. 2A-2D, the stem 122 may have a lower thermal conductivity than tungsten and a higher coefficient of thermal expansion than tungsten. Table 1 illustrates some materials that have these properties. Additionally, each of these materials is electrically conductive. The first row of Table 1 shows the characteristics of tungsten for comparison purposes. It is noted that this table is not intended to be exhaustive; rather it simply illustrates several possible materials that may be used for the stem 122 in these embodiments where the repeller head 121 is made of tungsten.

TABLE 1

| Material | Thermal Conductivity (W/mK) | Coefficient of Thermal Expansion (ppm/K) | Melting Point (° C.) |
|---|---|---|---|
| Tungsten | 174 | 4.5 | 3422 |
| Tantalum | 57 | 6.3 | 3017 |
| Titanium | 22 | 8.6 | 1668 |
| Rhenium | 48 | 6.2 | 3192 |
| Hafnium | 23 | 5.9 | 2233 |
| 300 Series SST | 16.4 | 17-18 | 1400 |
| KOVAR ® | 17 | 5.3 | 1449 |

Of course, this table is only illustrative, as the repeller head 121 may be constructed of a different material, such as molybdenum, tantalum, rhenium or another metal. Regardless of the material used for the repeller head 121, the material for the stem 122 is selected so as to have a lower thermal conductivity than the repeller head 121.

In certain embodiments, there may be a minimum acceptable melting temperature for the first material and the second material to allow proper operation within the IHC ion source 10. In some embodiments, this minimum melting temperature may be 1000° C. In other embodiments, this minimum melting temperature may be 1400° C. Each of the materials listed in Table 1 satisfy this limitation.

Figure 3:
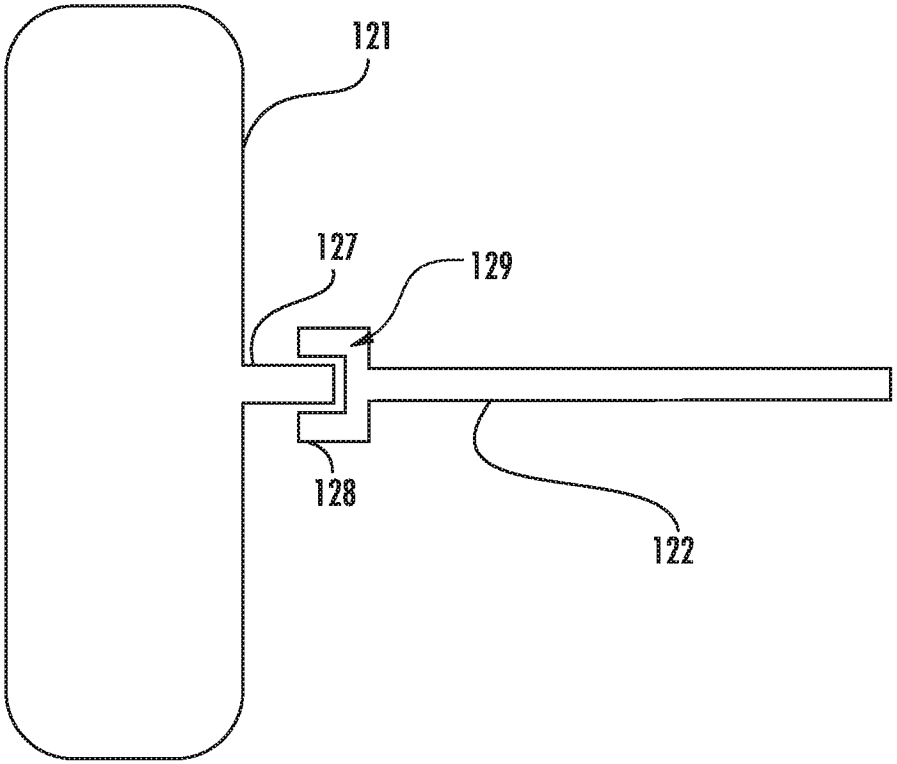
FIG. 3 shows a view of the connection between the repeller head and the stem according to another embodiment.

Other connections between the repeller head 121 and the stem 122 are also possible. For example, FIG. 3 shows an embodiment where the repeller head 121 has a post 127 extending from its back surface. The stem 122 has an annular ring 128 extending from its distal end, creating a cavity 129 at the end of the stem 122. In this embodiment, the post 127 from the repeller head 121 extends into the cavity 129 created by the annular ring 128 on the end of the stem 122.

In this embodiment, it may be beneficial for the repeller head 121 to have a greater coefficient of thermal expansion than the stem 122, such that the post 127 expands more than the cavity 129. Table 2 shows a possible material that may be used for the embodiment shown in FIG. 3 when the repeller head 121 is made of tungsten. It is noted that this table is not intended to be exhaustive, rather it simply illustrates one possible material that may be used for the stem 122 in this embodiment. As described above, this material is also electrically conductive.

TABLE 2

| Material | Thermal Conductivity (W/mK) | Coefficient of Thermal Expansion (ppm/K) | Melting Point (° C.) |
|---|---|---|---|
| Tungsten | 174 | 4.5 | 3422 |
| INVAR ® | 10 | 0.6 | 1427 |

As described above, in certain embodiments, there may be a minimum acceptable melting temperature for the second material to allow proper operation within the IHC ion source 10. In some embodiments, this minimum melting temperature may be 1000° C. In other embodiments, this minimum melting temperature may be 1400° C. The material listed in Table 2 satisfies this limitation.

While the previous description discloses a press fit between the post and the cavity, other configurations are also possible. For example, in certain embodiments, the post may be cooled while the cavity is heated during the insertion process, such that an interference fit is created when the post and cavity reach a common temperature. In other embodiments, only the post is cooled prior to insertion. In yet other embodiments, only the cavity is heated prior to insertion. In each of these embodiments, the temperatures of the post and cavity are manipulated to allow the post to fit within the cavity during insertion. After thermal equilibrium is reached, an interference fit is created. Thus, an interference fit is a special type of press fit.

In yet other embodiments, the repeller head 121 and the stem 122 may be welded, soldered or otherwise joined together.

The embodiments described above in the present application may have many advantages. As described above, IHC ion sources are susceptible to short life and performance degradation due to the material build-up on the repeller. By reducing the thermal conductivity of the stem 122, the repeller head 121 retains more of the heat imparted to it by the plasma and energetic electrons and ions. This serves to raise the temperature of the repeller head 121, which reduces the build-up of material on its front surface. In certain embodiments, the temperature of the repeller head 121 may increase 150-250° C. through the use of a stem 122 that is made of a second material, having a thermal conductivity that is one third that of tungsten.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. An indirectly heated cathode ion source, comprising:
an ion source chamber into which a gas is introduced;
a cathode disposed on one end of the ion source chamber; and
a repeller disposed at an opposite end of the ion source chamber, the repeller comprising a repeller head disposed within the ion source chamber and a stem that supports the repeller head and exits the ion source chamber through an opening;
wherein the repeller head is made of a first material and the stem is made from a second material, different than the first material, and
wherein the first material has a first thermal conductivity and the second material has a second thermal conductivity and the second thermal conductivity is less than half of the first thermal conductivity.

2. The indirectly heated cathode ion source of claim 1, wherein the second thermal conductivity is less than a third of the first thermal conductivity.

3. The indirectly heated cathode ion source of claim 1, wherein the repeller head and the stem are connected using a press fit.

4. The indirectly heated cathode ion source of claim 3, wherein the repeller head and the stem are connected using an interference fit.

5. The indirectly heated cathode ion source of claim 3, wherein the repeller head comprises a cavity disposed on a back surface, and wherein the stem is inserted into the cavity.

6. The indirectly heated cathode ion source of claim 5, wherein the first material has a first coefficient of thermal expansion and the second material has a second coefficient of thermal expansion and the second coefficient of thermal expansion is greater than the first coefficient of thermal expansion.

7. The indirectly heated cathode ion source of claim 3, wherein the repeller head comprises a post disposed on a back surface, and wherein a cavity is disposed at an end of the stem, and the post is inserted into the cavity.

8. The indirectly heated cathode ion source of claim 7, wherein the first material has a first coefficient of thermal expansion and the second material has a second coefficient of thermal expansion and the first coefficient of thermal expansion is greater than the second coefficient of thermal expansion.

9. A repeller for use within an ion source chamber, comprising:
a repeller head disposed within the ion source chamber; and
a stem, having a cross-sectional area that is smaller than a cross-sectional area of the repeller head, that supports the repeller head and exits the ion source chamber through an opening;
wherein the repeller head is made of a first material and the stem is made from a second material, different than the first material, wherein a thermal conductivity of the second material is less than half of a thermal conductivity of the first material.

10. The repeller of claim 9, wherein the thermal conductivity of the second material is less than a third of the thermal conductivity of the first material.

11. The repeller of claim 9, wherein the repeller head comprises tungsten.

12. The repeller of claim 9, wherein the stem is in electrical communication with a repeller power supply to supply a voltage to the repeller head.

13. The repeller of claim 9, wherein the stem is made from a material selected from the group consisting of tantalum, titanium, rhenium, hafnium, stainless steel, KOVAR® and INVAR®.

14. The repeller of claim 9, wherein the repeller head and the stem are connected using a press fit.

15. The repeller of claim 14, wherein the repeller head and the stem are connected using an interference fit.

16. A repeller for use within an ion source chamber, comprising:
a disc-shaped repeller head disposed within the ion source chamber and biased at a voltage; and
a stem attached to a back surface of the disc-shaped repeller head and exiting the ion source chamber through an opening;
wherein the disc-shaped repeller head and the stem are both electrically conductive and made from materials having a melting point greater than 1000° C., and wherein a thermal conductivity of the disc-shaped repeller head is at least twice as great as a thermal conductivity of the stem.

17. The repeller of claim 16, wherein the disc-shaped repeller head is made of tungsten.

18. The repeller of claim 17, wherein the stem is made from a material selected from the group consisting of tantalum, titanium, rhenium, hafnium, stainless steel, KOVAR® and INVAR®.

19. A repeller for use within an ion source chamber, comprising:

a repeller head disposed within the ion source chamber; and a stem, having a cross-sectional area that is smaller than a cross-sectional area of the repeller head, that supports the repeller head and exits the ion source chamber through an opening;

wherein the repeller head is made of a first material and the stem is made from a second material, different than the first material, wherein the first material has a higher thermal conductivity than the second material, wherein the repeller head comprises a cavity disposed on a back surface, and wherein the stem is inserted into the cavity and wherein the first material has a first coefficient of thermal expansion and the second material has a second coefficient of thermal expansion and the second coefficient of thermal expansion is greater than the first coefficient of thermal expansion.

20. A repeller for use within an ion source chamber, comprising:

a repeller head disposed within the ion source chamber; and a stem, having a cross-sectional area that is smaller than a cross-sectional area of the repeller head, that supports the repeller head and exits the ion source chamber through an opening;

wherein the repeller head is made of a first material and the stem is made from a second material, different than the first material, wherein the first material has a higher thermal conductivity than the second material, wherein the repeller head comprises a post disposed on a back surface, and wherein a cavity is disposed at an end of the stem, and the post is inserted into the cavity.

21. The repeller of claim 20, wherein the first material has a first coefficient of thermal expansion and the second material has a second coefficient of thermal expansion and the first coefficient of thermal expansion is greater than the second coefficient of thermal expansion.

* * * * *